United States Patent [19]

Luttermöller

[11] Patent Number: 4,713,257

[45] Date of Patent: Dec. 15, 1987

[54] SPRAYING METHOD AND DEVICE FOR APPLYING A FILM TO A WORKPIECE

[75] Inventor: Jürgen Luttermöller, Bielefeld, Fed. Rep. of Germany

[73] Assignee: Kopperschmidt-Müller GmbH & Co. KG, Bielefeld, Fed. Rep. of Germany

[21] Appl. No.: 830,972

[22] Filed: Feb. 19, 1986

[30] Foreign Application Priority Data

Feb. 19, 1985 [DE] Fed. Rep. of Germany ..... 3505618

[51] Int. Cl.[4] ..... B05D 1/04; B05B 5/04; B05B 7/06

[52] U.S. Cl. ..... 427/27; 239/3; 239/8; 239/296; 239/300; 239/696; 239/706; 239/708; 427/424; 427/426

[58] Field of Search ..... 239/419, 424, 427.5, 239/3, 8, 9, 11, 705–708, 296, 300, 290, 696, 527, 528, 414, 415; 427/424, 27, 426

[56] References Cited

U.S. PATENT DOCUMENTS

| | | | |
|---|---|---|---|
| 2,829,006 | 4/1958 | Johansson | 427/426 X |
| 3,385,526 | 5/1968 | Furrer | 239/424 X |
| 3,599,038 | 8/1971 | Skidmore | 118/621 X |
| 3,764,068 | 10/1973 | Lacchia | 239/424 X |
| 3,927,833 | 12/1975 | Harrison et al. | 239/306 |
| 4,263,346 | 4/1981 | Sandell | 427/196 |

FOREIGN PATENT DOCUMENTS 647713 7/1937 Fed. Rep. of Germany .

2127874 10/1972 France .

*Primary Examiner*—Evan K. Lawrence

*Attorney, Agent, or Firm*—Peter K. Kontler

[57] ABSTRACT

A spray gun for applying a film to a workpiece has a spray head provided with an annular nozzle designed to discharge material which is to undergo pneumatic atomization. A second annular nozzle surrounds the pneumatic material discharge nozzle and is designed to discharge atomizing air for pneumatic atomization of the material issuing from the pneumatic material discharge nozzle. The spray head is further provided with an additional material discharge nozzle designed to discharge material which is to undergo hydrostatic atomization. The hydrostatic material discharge nozzle is disposed centrally of, and is surrounded by, the pneumatic material discharge nozzle. The hydrostatic material discharge nozzle forms a first spray of hydrostatically atomized material while the annular nozzles form a hollow conical second spray which surrounds the first spray when both sprays are on simultaneously. The spray gun is capable of creating a spray pattern exhibiting the characteristics of a pneumatically generated spray as well as the characteristics of a hydrostatically generated spray. The material supplied to the pneumatic material discharge nozzle may be the same as that supplied to the hydrostatic material discharge nozzle or each of these nozzles may be supplied with a different component of a two-component substance.

30 Claims, 4 Drawing Figures

5
3
13
9
2
13
60
6
25
21

1
42
5
2
18
60
32
36
30
37
41
45
3
46
44
43
4
28
29
39
38
40
35
34
25

SPRAYING METHOD AND DEVICE FOR APPLYING A FILM TO A WORKPIECE

BACKGROUND OF THE INVENTION

The invention relates generally to a method of and a device for applying a film or a coating to a workpiece.

More particularly, the invention relates to a method of and a device for spraying a film or a coating onto a workpiece.

A known procedure for applying a film or a coating to a workpiece involves the use of a first spray consisting of pneumatically atomized material and a second spray consisting of hydrostatically atomized material. Pneumatic atomization is performed with a nozzle having a material discharge opening and an air discharge opening. Material to be atomized is delivered to the material discharge opening while air at a pressure sufficient to atomize the material, e.g., at a pressure of 1 to 10 bars, is delivered to the air discharge opening. The material is drawn through the material discharge opening due to suction created by the atomizing air or is advanced through the material discharge opening under low pressure. In hydrostatic atomization, on the other hand, material to be atomized is forced through a relatively small nozzle at such a high pressure, e.g., at a pressure of 30 to 500 bars, that the material atomizes upon issuing from the nozzle. During spraying of the workpiece, the workpiece and the sprays are moved relative to one another.

U.S. Pat. No. 3,927,833 to Harrison et al. discloses an atomizing device having three spray heads which are arranged next to one another in such a manner that the axis of each head extends at an angle to the axes of the other heads. The two outermost heads function to hydrostatically atomize a first material which is under hydraulic pressure while the central head functions to pneumatically atomize a second material by means of compressed air. The device further has discharge openings through which a particulate material and a fibrous material are fed to the sprays issuing from the heads. A common control unit is provided for the spray heads and the supply means for the particulate and fibrous materials, and the control unit has a lever which enables the supply means and all of the heads to be placed into operation simultaneously.

The device of Harrison et al. has the drawback that it yields a very non-uniform coat. The reason is that each of the three sprays entrains air from the surroundings. Therefore, air cushions are formed between neighboring sprays, and these air cushions affect the homogeneity of mixing as well as the completeness of the spray pattern. As regards mixing, symmetry exists across the central plane, and the combined sprays expand in the direction of such plane. The application of material to a workpiece during relative horizontal movement of the atomizing device and the workpiece differs significantly from that which occurs during relative vertical movement. Furthermore, the homogeneity of mixing and the completeness of the spray pattern depend in large measure upon the distance between the atomizing device and the workpiece. Moreover, the atomizing device is large and heavy. It can hardly be manipulated manually and it is difficult or impossible to introduce the spray heads into cavities.

German Patent No. 647 713 discloses an atomizing device in the form of a spray gun which is capable of producing a spray by pneumatic atomization only. The spray head of this device has a pneumatic atomizing arrangement including a material discharge nozzle which is supplied with a material to be atomized at low pressure, and an air discharge nozzle which is supplied with at least one current of atomizing air at a pressure sufficient to atomize the material. The spray head is further provided with outlet openings for the discharge of additional currents of air into the spray. The device includes a control unit with a manually operable lever which controls valves for the air and the material to be atomized. Air flows to the air discharge nozzle and the outlet openings through a common air valve. An adjustable throttling mechanism makes it possible to vary the ratio of atomizing air to additional air. The pneumatic atomization results in a spray which consists of fine droplets and can produce a film of only limited thickness. If it is attempted to increase the film thickness by increasing the throughput of material to be atomized, atomization worsens considerably. While it is possible to reduce or avoid worsened atomization by increasing the air pressure and thereby increasing the throughput of air this causes disturbances due to the creation of a dense mist.

French Patent No. 2.127.874 discloses an atomizing device in which atomization is effected purely hydrostatically. This device is capable of producing large film thicknesses in a single operation. However, poor overlap is obtained due to the well-defined character of the spray. Since the conditions of use as well as the types of coating material are essentially determined by the nozzle geometry, there is little flexibility in regard to the operating conditions. Regulation of the quantity of material during application is not possible. If it is attempted to reduce the throughput of material by employing a smaller nozzle, blockages occur. On the other hand, it it is attempted to reduce the throughput by reducing the pressure on the material, the droplet size of the spray increases.

Material subjected to hydrostatic atomization may be exposed to one or more air currents which serve to assist in spray formation or to effect a slight secondary atomization. While this permits the droplet size to be increased, the drawbacks associated with pure hydrostatic atomization basically remain. A fine, uniform film such as obtained with pneumatic atomization is not achieved.

U.S. Pat. No. 3,599,038 to Skidmore discloses an atomizing device equipped with an electrostatic charging unit. Here, the workpiece to be coated is grounded, and the droplets of the spray are electrostatically charged by a high voltage electrode before travelling to the workpiece. This results in a shrouding of the workpiece which improves the coating efficiency, particularly for filigree articles. In pheumatic-electrostatic atomization, the kinetic energy of the samll droplets is reduced in order to improve the electrostatic effect. This, however, causes poorer penetration of the droplets into the recesses of a workpiece (Faraday Effect), e.g., into the spaces between the cooling ribs of a motor casing, and also causes excessive coating of the edges. In hydrostatic-electrostatic atomization carried out at higher pressures, the droplets likewise have a kinetic energy which is excessive from the electrostatic point of view although favorable as regards penetration of the droplets into recesses. If the pressure on the material to be atomized is reduced so as to achieve better utilization of the electrostatic effect, the size of the droplets increases.

OBJECTS AND SUMMARY OF THE INVENTION

It is an object of the invention to provide a method which makes it possible to spray a substantially uniform film or coating onto a workpiece more easily than heretofore.

Another object of the invention is to provide a device which is capable of spraying a substantially uniform film or coating onto a workpiece with less difficulty than previously.

The preceding objects, as well as others which will become apparent as the description proceeds, are achieved by the invention.

One aspect of the invention resides in the provision of a method of applying a film or a coating to a workpiece. The method comprises the steps of atomizing a material to generate a first spray within a predetermined space, and atomizing a material to generate a second spray which surrounds such space. One of the sprays is generated pneumatically while the other of the sprays is generated hydrostatically, and the two sprays are directed against the workpiece.

The second spray preferably defines a hollow shape such as, for example, a hollow cone. When the sprays are on simultaneously, the first spray may then be considered to constitute a core of the second spray.

The workpiece and the sprays are advantageously moved relative to one another during application of the film or coating to the workpiece.

Since one of the sprays surrounds the other, it is much easier to obtain uniform mixing. Thus, the formation of a cushion of entrained air between the sprays may be avoided. Moreover, a complete or unbroken spray pattern may be created regardless of whether the core spray is round or flat. When a round spray is employed, it is even possible to achieve point symmetry such that the uniformity of film deposition is totally independent of relative movement of the workpiece and the spraying or atomizing device. The distance between the spraying device and the workpiece may also be varied within limits without a sacrifice in the quality of the results.

It is further possible to form a substantially uniform film or coat even on highly structured surfaces. In addition, medium film thicknesses may be obtained. Moreover, there is only a slight misting effect so that faults in the film occasioned by such effect are correspondingly small. Also, smooth transitions may be achieved in the regions of overlap. In optimum situations, adjustment of the spray characteristics and quantity regulation may be carried out during spraying.

Furthermore, the spraying device may be small and light and may even be in the form of a manually operated gun or pistol. The spray head may likewise be small so that it can be inserted in cavities.

It is possible for the second or hollow spray and the first core spray to consist of the same material. This enables entirely new coating possibilities to be realized.

The hollow spray and the core spray may be produced alternatively. Thus, hydrostatic atomization may be employed only in those cases where the coating material must penetrate relatively deep cavities while pneumatic atomization is used in all other cases.

It is also possible to produce the hollow spray and the core spray simultaneously. This gives rise to a new droplet spectrum which depends upon the ratio of pneumatically and hydrostatically atomized material. The advantages of both types of atomization can therefore be employed to achieve optimum coating. A synergistic effect arises here in that a much lower proportion of hydrostatically atomized material is required to coat the surfaces of cavities, e.g., only 30% instead of 70% when coating via hydrostatic atomization alone. The reason is that the droplets generated by hydrostatic atomization are very energetic and carry along a substantial portion of the pneumatically created droplets into a cavity being coated. This is particularly true when the droplets are electrostatically charged.

When the hollow and core sprays are used simultaneously, the two types of atomization combine to produce a film of medium thickness. Moreover, smooth transitions are present in regions of overlap despite the hydrostatic atomization.

It is particularly favorable for the hydrostatically atomized material to constitute 20 to 40 percent, and preferably 30 percent, of the total quantity of atomized material. This yields, on average, an optimum combination of spray characteristics which allows greatly differing structured surfaces to be uniformly coated.

It is frequently favorable for the hollow spray and the core spray to consist of different materials. For instance, in order to obtain optimum atomization, materials having different viscosities may be used for the respective sprays. The materials may also have different colors to thereby achieve specific surface effects. The materials employed for the respective sprays may further be selected in such a manner that the desired coating substance is obtained only when the materials are combined. In particular, the hollow spray and the core spray may each consist of one component of a two-component substance such as a two-component lacquer.

With respect to the foregoing, it is of advantage for the two sprays to mix a substantial degree before imginging upon the workpiece. This yields a better mixing action than when the droplets of different materials impinge upon the workpiece sequentially.

According to a preferred embodiment, the core spray is composed of hydrostatically atomized material while the hollow spray is composed of pneumatically atomized material. Since the hollow spray protects the core spray against penetration by atmospheric air, definite atomization characteristics are achieved. To the extent that the outside of the hollow spray mixes with air from the surroundings, this is desirable because, instead of a sharp transition such as in pure hydrostatic atomization, a smooth transition with the possibility of an overlap during coating is then obtained.

Frequently, it is also favorable for the core spray to have a smaller spray angle than the hollow spray. In this case, there are two distinct spray regions including an inner region which enhances penetration of the droplets into the cavities of a workpiece, and an outer region which coats the outer surfaces of the workpiece and makes it possible to effectively shroud the latter when the droplets are electrostatically charged.

It is particularly advantageous to electrostatically charge the droplets of the sprays. As is known, the charge increases the proportion of droplets which deposit upon the surface of the workpiece to be coated. However, until now, it was nevertheless practically impossible to coat the surfaces of cavities using electrostatic charging in conjunction with pneumatic atomization since the electrostatic field penetrates cavities to only a limited extent. The method of the invention, which additionally employs hydrostatic atomization, makes it feasible for the first time to coat a cavity with a film possessing at least some characteristics of films formed by atomization of the pneumatic type alone.

Another aspect of the invention resides in the provision of a device for applying a film or a coating to a workpiece. The device comprises a spray head, first nozzle means in the spray head for generating a first spray within a predetermined space, and a second nozzle means in the spray head for generating a second spray which surrounds the predetermined space. Material supply means is provided for supplying material to be pneumatically atomized to one of the nozzle means and for supplying material to be hydrostatically atomized to the other of the nozzle means. Air supply means is arranged to supply at least one current of atomizing air to the pneumatic nozzle means. The device further includes control means for the air and material supply means.

The material supply means may be designed to supply material to the hydrostatic nozzle means at a first pressure sufficient to cause hydrostatic atomization of the material delivered to the hydrostatic nozzle means and to supply material to the pneumatic nozzle means at a lower second pressure. The air supply means may be designed to supply air to the pneumatic nozzle means at a pressure sufficient to cause pneumatic atomization of the material delivered to the pneumatic nozzle means. The control means may include valve means for regulating the flow of air and material.

The device may be provided with auxiliary means for subjecting at least one of the sprays to the action of an air current other than that which flows to the pneumatic nozzle means. This auxiliary or additional air current may assist in the formation of one or both sprays, or may effect secondary atomization of the material issuing from one or both nozzle means. The additional air current may also function to reduce the pressure required for hydrostatic atomization. The auxiliary means may include at least one opening in the spray head, and the air supply means may be arranged to supply air to the opening.

As stated above, the first nozzle means generates a first spray within a predetermined space while the second nozzle means generates a second spray which surrounds such space. It is preferred for the hydrostatic nozzle means to constitute the first nozzle means and for the pneumatic nozzle means to constitute the second nozzle means. Furthermore, the pneumatic nozzle means advantageously comprises a substantially circumferentially complete material discharge nozzle, and a substantially circumferentially complete air discharge nozzle. One of the nozzles surrounds the other of the nozzles, and each of the nozzles surrounds the first nozzle means. The material discharge nozzle and the air discharge nozzle may be substantially annular, and the air discharge nozzle preferably surrounds the material discharge nozzle.

The spraying device of the invention may be used with particular advantage for performing the method of the invention.

The pneumatic and hydrostatic nozzle means may be at least approximately concentric. When the pneumatic and hydrostatic nozzle means operate simultaneously, good mixing of the two sprays may be achieved.

As stated above, the material discharge nozzle and air discharge nozzle of the pneumatic nozzle means may be substantially annular. The hydrostatic nozzle means may comprise a circular nozzle and, in such an event, the pneumatic and hydrostatic sprays have similar shapes when the pneumatic and hydrostatic nozzle means are operated alternatively. It is also possible for the hydrostatic nozzle means to be in the form of a slotted nozzle such as is frequently used for hydrostatically atomization and to arrange the slotted nozzle so that it is circumscribed by the annular material and air discharge nozzles of the pneumatic nozzle means. The slotted nozzle generates a fan-shaped core spray which, upon simultaneous activation of the pneumatic and hydrostatic nozzle means, causes the hollow outer spray to deviate from its normal conical configuration.

The control means or control unit for the material supply means and air supply means may have one or more valves for regulating the flow of atomizing air to the pneumatic nozzle means and the flow of auxiliary air to the respective opening or openings in the spray head. Advantageously, the control unit is designed in such a manner that, when the hydrostatic nozzle means is activated, the valve or valves for the atomizing air and/or the auxiliary air open. The air outlets which are normally employed for pneumatic atomization may then be used during hydrostatic atomization also.

The material supply means may include first conduit means for delivering material to the pneumatic nozzle means, and second conduit means for delivering material to the hydrostatic nozzle means. If the pneumatic nozzle means and the hydrostatic nozzle means are to be supplied with the same material, it is of advantage to establish communication between the first and second conduit means via a pressure reducing mechanism such as an adjustable throttle or a pressure regulator. Only a single pressure source is then required to advance the material to the respective nozzle means.

The conduit means for the hydrostatic nozzle means is favorably supplied with material by means of a pressure regulated or variable pump. The hydrostatic pressure can then be maintained at a constant value and also changed as necessary.

It is particularly advantageous to provide the spray head with an electrode for electrostatic charging of the atomized material. Such a combination enables a very uniform coating to be achieved since those regions of a highly structured surface which are shielded from the electrostatic field are reached by the hydrostatically atomized material.

The valve means or valves of the control unit may be operable manually or may be power operated, that is, may be operated pneumatically, hydraulically, electromagnetically, and so on. While each of the valves may be controlled independently, it is of advantage for at least some of the valves to be coupled to one another.

The control unit may be equipped with an operating element having a first operative position in which the first nozzle means but not the second is activated, and a second operative position in which the second nozzle means but not the first is activated.

Alternatively, the control unit may be provided with an operating element having a first operative position in which one of the nozzle means but not the other is activated, and the second operative position in which the pneumatic and hydrostatic nozzle means are activated simultaneously.

The novel features which are considered as characteristic of the invention are set forth in particular in the appended claims. The improved spraying device itself, however, both as to its construction and its mode of operation, together with additional features and advantages thereof, will be best understood upon persual of the following detailed description of certain specific embodiments with reference to the accompanying drawings.

BRIEF DESCRIPTION OF THE DRAWINGS

FIG. 5 shows another embodiment of the control unit.

DESCRIPTION OF THE PREFERRED EMBODIMENTS

Figure 2:
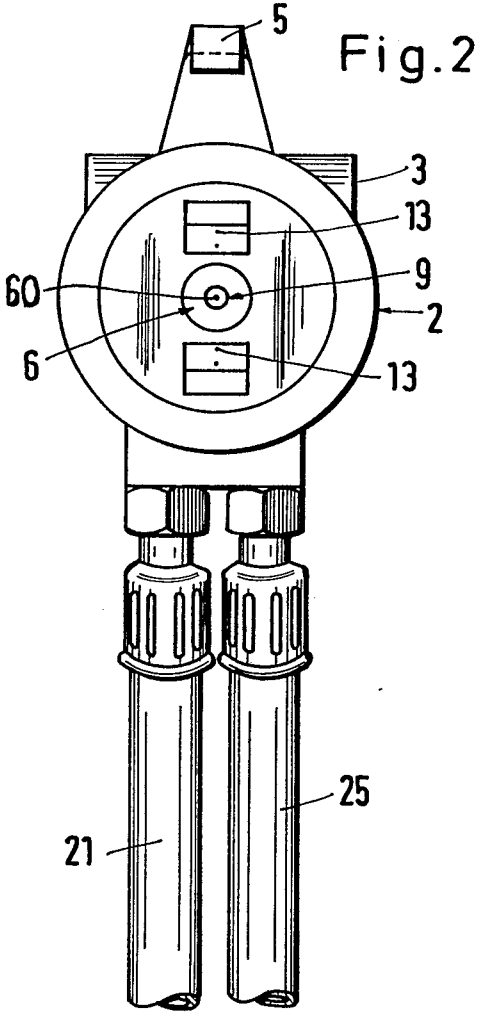
FIG. 2 is a front view of the spraying device of FIG. 1.
Figure 1:
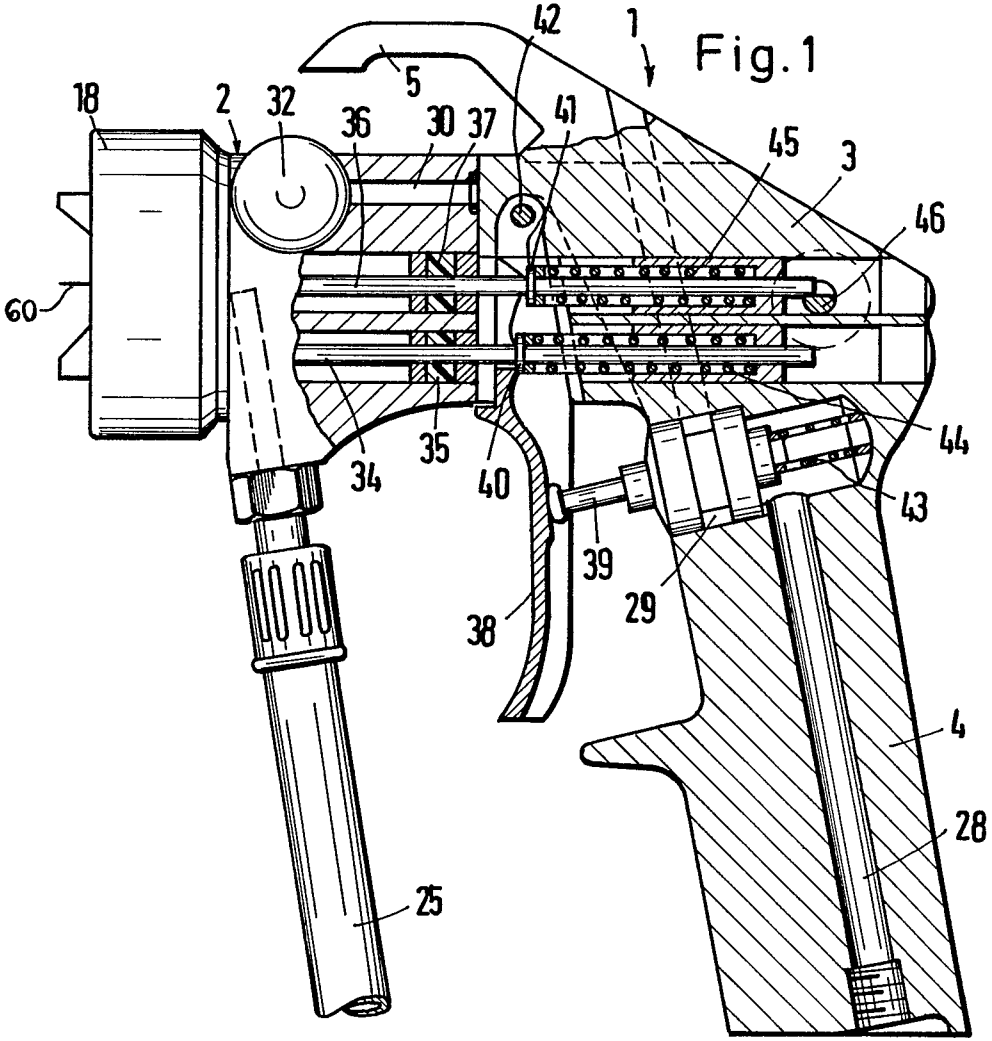
FIG. 1 is a partly sectional elevational view of a spraying device in accordance with the invention.

Referring to FIGS. 1 and 2, a spraying device in the form of a gun or pistol is generally identified by the reference numeral 1. The spray gun 1 has a spray head 2 which is secured to a housing 3. The latter is provided with a handle 4 for gripping the spray gun 1 as well as a hook 5 for hanging up the spray gun 1.

Figure 3:
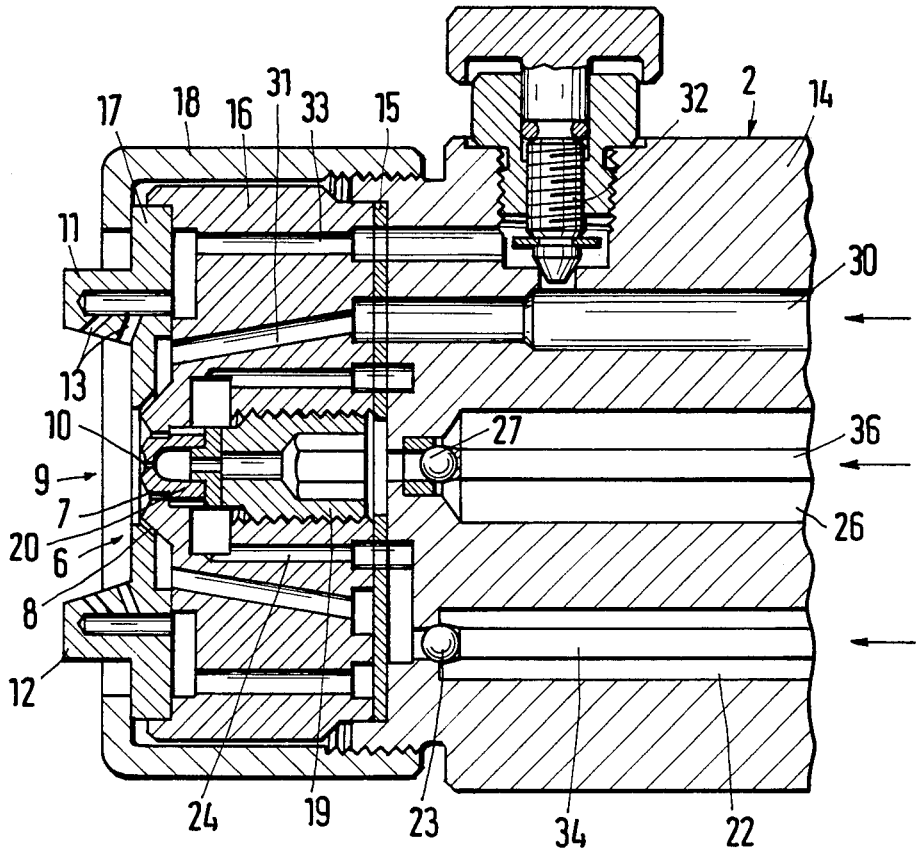
FIG. 3 is a longitudinal sectional view of the spray head constituting part of the spraying device of FIG. 1.

As shown in FIG. 3, the spray head 2 has a nozzle means 6 which functions to pneumatically atomize material. The pneumatic nozzle means 6 includes an annular material discharge nozzle 7, and an annular air discharge nozzle 8 for atomizing air which circumscribes the material discharge nozzle 7. The spray head 2 is further provided with an additional nozzle means 9 which serves for hydrostatic atomization of material. The hydrostatic nozzle means 9 comprises a material discharge nozzle 10 which is situated centrally of the pneumatic material discharge nozzle 7. Thus, the hydrostatic material discharge nozzle 10 is surrounded by the pneumatic material discharge nozzle 7 which, in turn, is surrounded by the pneumatic air discharge nozzle 8. The hydrostatic material discharge nozzle 10 may be circular in which case the discharge nozzles 7, 8, 10 are preferably concentric. It is, however, possible for the hydrostatic material discharge nozzle 10 to be constituted by a slotted nozzle. In any event, the hydrostatic nozzle means 9 generates a first spray within a predetermined or defined space while the pneumatic nozzle means 6 generates a second spray which surrounds such space. The second or pneumatic spray preferably defines a hollow shape such as, for example, a hollow cone. When the two sprays are on simultaneously, the first or hydrostatic spray may be considered to constitute a core of the pneumatic spray.

The spray head 2 has a pair of tips or extensions 11 and 12 which are provided with air outlet openings 13. The air outlet openings 13 constitute an auxiliary air discharge means for subjecting the sprays generated by the pneumatic nozzle means 6 and the hydrostatic nozzle means 9 to the action of additional or auxiliary air. Such auxiliary air may assist in the formation of the sprays, may improve atomization, and may function to reduce the pressure required to advance material to the hydrostatic nozzle means 9.

In order to form the nozzle means 6, 9, the spray head 2 is provided with a block 14. A distributing element or distributor 16 is disposed to the front of the block 14, and a sealing disc 15 is arranged between the block 14 and the distributor 16. A plate 17 carrying the extensions 11, 12 is located in front of the distributor 16, and the plate 17 and distributor 16 are held fast with the block 14 by means of a cap screw 18. An insert 19 is screwed into the interior of the distributor 16 and supports a nozzle body 20. The outer periphery of the nozzle body 20 cooperates with the distributor 16 to define the pneumatic material discharge nozzle 7. The central portion of the nozzle body 20, on the other hand, defines the hydrostatic material discharge nozzle 10.

Figure 4:
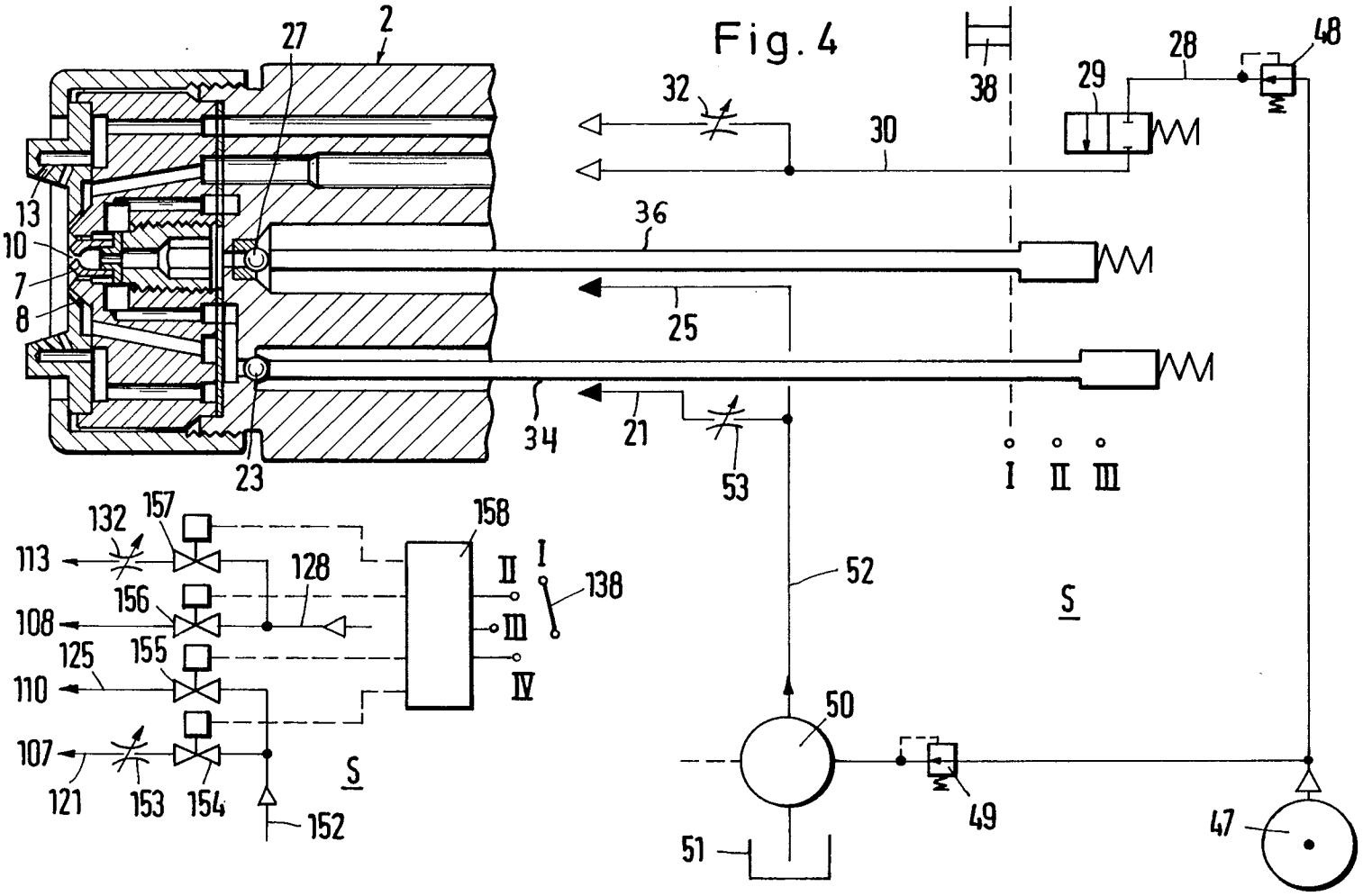
FIG. 4 illustrates a control unit for the spraying device of FIG. 1.

Referring now to FIG. 4 in conjunction with FIGS. 1–3, material supply means for supplying material to the material discharge nozzles 7, 10 includes a first external material supply line 21 which is arranged to supply material to the discharge nozzle 7. The material supply line 21 communicates with the discharge nozzle 7 via an axial passage 22 in the block 14, axial passages 24 in the distributor 16, and a material valve 23 disposed between the passages 22 and 24. The material supply means further comprises a second external material supply line 25 for delivering material to the discharge nozzle 10. The material supply line 25 communicates with the discharge nozzle 10 by means of an axial passage 26 in the block 14, and a material valve 27 located between the passage 26 and the discharge nozzle 10.

Air supply means for supplying atomizing air to the pneumatic air discharge nozzle 8 and for supplying auxiliary air to the air outlet openings 13 includes an air supply passage 28 extending through the handle 4 of the spray gun 1. The air supply passage 28 is controlled by a slide valve 29. The air discharge nozzle 8, which is defined by the distributor 16 and the plate 17, communicates with the air supply passage 28 via an axial passage 30 in the block 14 and a first set of air supply bores 31 in the distributor 16. The air outlet openings 13, on the other hand, communicate with the air supply passage 28 by means of the axial passage 30, a second set of air supply bores 33 in the distributor 16, and an adjustable throttle 32 disposed between the axial passage 30 and the second set of air supply bores 33.

The material supply line 21; the passage 22; the passages 24; the material supply line 25; and the passage 26 may all be considered to constitute part of the material supply means. Similarly, the air supply passage 28; the passage 30; the bores 31; the throttle 32; and the bores 33 may all be considered to constitute part of the air supply means. On the other hand, the material valves 23 and 27, as well as the slide valve 29, constitute part of a control unit S for the spray gun 1.

The control unit S further includes a control rod 34 for the material valve 23 and a second control rod 36 for the material valve 27. The control rod 34 extends through a sealing element 35 located in the passage 22 while the control rod 36 extends through a sealing element 37 disposed in the passage 26. The control unit S additionally comprises a manually operable trigger or operating lever 38 which is pivotable on a pivot 42 mounted on the housing 3 of the spray gun 1. A plunger 39 projects from the slide valve 29 towards the trigger 38, and the latter is arranged to operate the slide valve 29 through the agency of the plunger 39. The trigger 38 also operates the material valves 23 and 27. To this end, a collar 40 is mounted on the control rod 34 for the material valve 23 whereas a collar 41 is mounted on the control rod 36 for the material valve 27. The collars 40, 41 are in abutment with the trigger 38 so that the control rods 34, 36, and hence the material valves 23, 27, are operated in response to movement of the trigger 38.

A return spring 43 bears against the handle 4 of the spray gun 1 and against the plunger 39 to thereby continuously urge the plunger 39 into abutment with the trigger 38. Similarly, a return spring 44 acts on the collar 40 os the control rod 34 and on an abutment in the housing 3 to urge the collar 40 against the trigger 38 while a return spring 45 acts on the collar 41 of the control rod 36 and on an abutment in the housing 3 to bias the collar 41 into engagement with the trigger 38. A rotatable stop 46 in the housing 3 allows the trigger 38, and hence the valves 23, 27, 29, to be locked.

As seen in FIG. 4, the air supply means further includes an air compressor 47, and a pressure-regulating valve 48 disposed between the compressor 47 and the air supply passage 28. FIG. 4 also shows that the material supply means additionally comprises a container 51 for material to be atomized, a material pump 50, a pressure line 52 establishing communication between the pump 50 and the material supply lines 21, 25, and an adjustable throttle 53 disposed between the material supply lines 21 and 25.

The compressor 47 forwards pressurized air to the air supply passage 28 via the pressure-regulating valve 48. The air pressure in the air supply passage 28 is sufficient to cause pneumatic atomization of the material delivered to the material discharge nozzle 7 of the pneumatic nozzle means 6.

The compressor 47 further delivers pressurized air to the motor of the material pump 50 through another pressure-regulating valve 49. The material pump 50 draws material from the container 51 and advances the material to the material supply lines 21, 25 through the pressure line 52. The pressure of the material in the material supply line 25 is so high that this material undergoes hydrostatic atomization at the material discharge nozzle 10 of the hydrostatic nozzle means 9. Since the material delivered to the material discharge nozzle 7 of the pneumatic nozzle means 6 need not be at such a high pressure, the throttle 53 is disposed between the material supply lines 21 and 25. The throttle 53 serves to reduce the pressure of the material entering the material supply line 21 to a valve suitable for pneumatic atomization.

The material pump 50 is a pressure-regulated or variable pump. This makes it possible to maintain a constant pressure in the material supply line 25 and also to change the pressure as necessary.

The trigger 38 has an inoperative position I as well as first and second operative positions II and III. In the first operative position II, only the material valve 27 is open so that material is supplied only to the material discharge nozzle 10 of the hydrostatic nozzle means 9 and only hydrostatic atomization occurs. In the second operative position III, the material valve 27 remains open and, in addition, the material valve 23 and the air slide valve 29 are opened. Thus, material is now supplied also to the material discharge nozzle 7 of the pneumatic nozzle means 6 while atomizing air is delivered to the air discharge nozzle 8 of the pneumatic nozzle means 6. Accordingly, both hydrostatic and pneumatic atomization take place in the second operative position III of the trigger 38. The resulting overall spray pattern has a spectrum of droplets made up of droplets obtained from both types of atomization.

The spray gun 1 may be designed in such a manner that two separate spray regions are obtained. For example, the inner hydrostatic spray which issues from the material discharge nozzle 10 may have a spray angle of 30° while the outer, hollow conical pneumatic spray generated through the agency of the material discharge nozzle 7 and the air discharge nozzle 8 may have a spray angle of 70°. It is also possible, however, for the two sprays to have spray angles such that the sprays mix with one another.

It will be observed that auxiliary air is delivered to the air outlet openings 13 of the spray head 2 in the second operative position III of the trigger 38.

As shown in FIGS. 1 and 2, the spray gun 1 may be provided with an electrode 60 for the purpose of electrostatically charging the droplets of the sprays. The electrode 60 is mounted at the front of the spray head 2 and may be either centrally or eccentrically disposed with respect to the latter. The main consideration is that the electrode 60 should be located within the flows of air and material issuing from the nozzle means 6, 9.

In FIGS. 1–4, the same material is delivered to the material discharge nozzle 7 of the pneumatic nozzle means 6 and the material discharge nozzle 10 of the hydrostatic nozzle means 9. Thus, a single material pump 50 may be used provided that the throttle 53 is disposed between the material supply lines 21 and 25 so that different pressures may exist therein. However, it is possible to supply different materials to the hydrostatic material discharge nozzle 10 and the pneumatic material discharge nozzle 7, e.g., different components of a two-component substance. The material pump 50 is then replaced by a pair of material pumps each of which draws material from a respective container and delivers the material to a respective material supply line 21 or 25.

FIG. 5 shows another embodiment of the control unit S. In FIG. 5, elements similar to those of FIGS. 1–4 are identified by the same reference numerals increased by one hundred.

In the embodiment of FIG. 5, the pneumatic material discharge nozzle 107 is controlled by its own valve 154; the hydrostatic material discharge nozzle 110 is controlled by its own valve 155; the pneumatic air discharge nozzle 108 is controlled by its own valve 156; and the auxiliary air outlet openings 113 are controlled by their own valve 157. Each of the valves 154–157 is connected with a switching box 158 via a respective conductor indicated by a dashed line. The switching box 158 is controlled by the operating lever 138.

The operating lever 138 has an inoperative position I as well as first, second and third operative positions II, III and IV. All of the valves 154–157 are closed in the inoperative position I. In the first operative position II, the valves 154, 156 and 157 are open so that material is delivered to the pneumatic material discharge nozzle 107 and air is delivered to the pneumatic air discharge nozzle 108 as well as to the auxiliary air outlet openings 113. Accordingly, pneumatic atomization takes place assisted by the auxiliary air. In the second operative position III, all of the valves 154–157 are open so that both pneumatic and hydrostatic atomization occur, again assisted by the auxiliary air. In the third operative position IV, only the valves 155 and 157 are open, and hydrostatic atomization alone takes place with the assistance of the auxiliary air.

It is thus possible to selectively employ pneumatic atomization alone, hydrostatic atomization alone, or both pneumatic and hydrostatic atomization together. In all cases, however, auxiliary air is supplied to assist in spray formation.

If necessary or desirable, the throttle 132 may be equipped with an automatic switching mechanism so that two different resistances to flow may be obtained.

The operating pressures depend upon the specific conditions and, in particular, upon the material to be atomized. In general, pneumatic atomization may be performed using atomizing air at a pressure of 20 to 40 bars. Hydrostatic atomization, on the other hand, may be performed by applying pressures of 30 to 500 bars to the material undergoing hydrostatic atomization. When hydrostatic atomization is carried out at pressures in the lower end of this range, an adequate quantity of auxiliary air at a pressure of several bars, e.g., 5 bars, should be employed.

The hydrostatically atomized material advantageously constitutes 20 to 40 percent, and preferably 30 percent, of the total quantity of atomized material. This yields a combination of spray characteristics which enables a variety of structured surfaces to be uniformly coated.

A pressure regulator may be substituted for each of the throttles 32, 132 and 53, 153. The hydrostatic material discharge nozzle 10 may be either in the form of a slit or in the form of a bore.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptions should and are intended to be comprehended within the meaning and range of equivalence of the appended claims.

I claim:

1. A method of applying a film to a workpiece, comprising the steps of atomizing a material to generate a first spray within a predetermined space; atomizing a material to generate a second spray which surrounds said space, one of said sprays being generated pneumatically and the other of said sprays being generated hydrostatically; and directing said sprays against said workpiece.

2. The method of claim 1, wherein said second spray defines a hollow shape.

3. The method of claim 2, wherein said second spray is substantially conical.

4. The method of claim 1, comprising the step of moving said workpiece and said sprays relative to one another.

5. The method of claim 1, wherein the same material is employed in both atomizing steps.

6. The method of claim 1, wherein the two atomizing steps are performed alternatively.

7. The method of claim 1, wherein the two atomizing steps are performed simultaneously.

8. The method of claim 1, wherein the amount of hydrostatically atomized material is about 20 percent to about 40 percent of the total amount of atomized material.

9. The method of claim 1, wherein the amount of hydrostatically atomized material is about 30 percent of the total amount of atomized material.

10. The method of claim 1, wherein different materials are employed in the two atomizing steps.

11. The method of claim 10, wherein the different materials constitute respective components of a multicomponent substance.

12. The method of claim 11, wherein said substance is a two-component substance.

13. The method of claim 1, wherein said first spray is said other spray.

14. The method of claim 1, wherein said first spray has a first spray angle and said second spray has a second spray angle greater than said first spray angle.

15. The method of claim 1, comprising said step of electrostatically charging said sprays.

16. The method of claim 1, wherein said one spray is generated by subjecting the material for said one spray to the action of at least one air current; and further comprising the step of subjecting at least one of said sprays to an additional air current.

17. A device for applying a film to a workpiece, comprising a spray head; first nozzle means in said head for generating a first spray within a predetermined space; second nozzle means in said head for generating a second spray which surrounds said space, said second nozzle means comprising a substantially circumferentially complete material discharge nozzle and a substantially circumferentially complete air discharge nozzle, said air discharge nozzle surrounding said material discharge nozzle and each of said nozzles surrounding said first nozzle means; material supply means for supplying material to be pneumatically atomized to said second nozzle means and for supplying material to be hydrostatically atomized to said first nozzle means; air supply means for supplying at least one current of atomizing air to said second nozzle means; and control means for said air and material supply means.

18. The device of claim 17, wherein said control means comprises valve means for regulating the flow of air and material.

19. The device of claim 17, comprising auxiliary means for subjecting at least one of the sprays to the action of an additional air current.

20. The method of claim 19, said auxiliary means including at least one opening in said head; and wherein said air supply means is arranged to supply air to said opening.

21. The device of claim 17, wherein said nozzles are substantially annular.

22. The device of claim 17, wherein said material supply means is designed to supply material to said first nozzle means at a first pressure sufficient to cause hydrostatic atomization of the material delivered to said first nozzle means and to supply material to said second nozzle means at a lower second pressure, said air supply means being designed to supply air to said second nozzle means at a pressure sufficient to cause pneumatic atomization of the material delivered to said second nozzle means.

23. The device of claim 17, wherein said control means is movable between a first position, and a second position in which said material supply means delivers material to said first nozzle means and said air supply means delivers air to said second nozzle means.

24. The device of claim 23, comprising auxiliary means for subjecting at least one of the sprays to the action of an additional air current, said air supply means being arranged to supply air to said auxiliary means; and wherein said air supply means delivers air to said auxiliary means in said second position of said control means.

25. The device of claim 17, comprising auxiliary means for subjecting at least one of the sprays to the action of an additional air current, said air supply means being arranged to supply air to said auxiliary means; and wherein said control means is movable between a first position, and a second position in which said material supply means delivers material to said first nozzle means and said air supply means delivers air to said auxiliary means.

26. The device of claim 17, wherein said material supply means comprises conduit means for delivering material to said first nozzle means, and variable pump means for pumping material to said conduit means.

27. The device of claim 17, comprising an electrode on said head for electrostatically charging the material issuing from said first and second nozzle means.

28. The device of claim 17, wherein said control means is movable between a first position in which atomization occurs at said second nozzle means but not said first nozzle means, and a second position in which atomization occurs at said first nozzle means but not said second nozzle means.

29. A device for appling a film to a workpiece, comprising a spray head; first nozzle means in said head for generating a first spray within a predetermined space; second nozzle means in said head for generating a second spray which surrounds said space; material supply means for supplying material to be pneumatically atomized to one of said nozzle means and for supplying material to be hydrostatically atomized to the other of said nozzle means, said material supply means comprising first conduit means for delivering material to said one nozzle means, second conduit means for delivering material to said other nozzle means, and means for establishing communication between said first and second conduit means, said establishing means including pressure reducing means; air supply means for supplying at least one current of atomizing air to said one nozzle means; and control means for said air and material supply means.

30. A device for applying a film to a workpiece, comprising a spray head; first nozzle means in said head for generating a first spray within a predetermined space; second nozzle means in said head for generating a second spray which surrounds said space; material supply means for supplying material to be pneumatically atomized to one of said nozzle means and for supplying material to be hydrostatically atomized to the other of said nozzle means; air supply means for supplying at least one current of atomizing air to said one nozzle means; and control means for said air and material supply means, said control means being movable between a first position in which atomization occurs at a single nozzle means and a second position in which atomization occurs at both nozzle ends.

* * * * *